US006185160B1

(12) United States Patent
Tsuda

(10) Patent No.: US 6,185,160 B1
(45) Date of Patent: Feb. 6, 2001

(54) WRISTWATCH

(75) Inventor: Jun Ichiro Tsuda, Tokyo (JP)

(73) Assignee: Innomind International Limited, Kwai Chung (HK)

( * ) Notice: Under 35 U.S.C. 154(b), the term of this patent shall be extended for 0 days.

(21) Appl. No.: 09/039,428

(22) Filed: Mar. 16, 1998

(30) Foreign Application Priority Data

Mar. 28, 1997 (JP) ..... 9-002817

(51) Int. Cl.[7] ..... G04B 19/30; G04B 19/00; G04B 37/00

(52) U.S. Cl. ..... 368/67; 368/223; 368/276; 368/285

(58) Field of Search ..... 368/67, 88, 276, 368/280, 285, 223, 227

(56) References Cited

U.S. PATENT DOCUMENTS 4,884,257 * 11/1989 Swardvski ..... 368/276
5,894,456 * 4/1999 Schneider ..... 368/67

FOREIGN PATENT DOCUMENTS

2218895 * 11/1989 (GB) .

* cited by examiner

*Primary Examiner*—Vit Miska
(74) *Attorney, Agent, or Firm*—Smith, Gambrell & Russell, LLP

(57) ABSTRACT

A wristwatch which is both practical and enjoyable. Light emitting elements are provided for emitting light by applying electric energy to a main watch body. By operating operation buttons which are provided to be operable from outside the main watch body, the light emitting elements are caused to flash sequentially for a prescribed period of time.

7 Claims, 5 Drawing Sheets

WRISTWATCH

BACKGROUND OF THE INVENTION

The present invention relates to a wristwatch including a light emitting element.

Conventionally, a wristwatch having, an illuminating device, has been provided so that time can be read in the darkness. However, the described wristwatch was provided for the practical purpose of illuminating the face and did not provide any entertaining feature. The present invention has an objective of solving the described problem and providing a wristwatch which is both practical and entertaining.

SUMMARY OF THE INVENTION

A wristwatch, according to the present invention, includes a plurality of light emitting elements provided for emitting light by applying electric energy to a main watch body and is characterized in that the light emitting elements are caused to flash sequentially for a prescribed time period by operating an operation button provided so as to be operable from outside the main watch body.

The operation button may have an operation memory function and, when being operated, make a sensor operable for sensing a vibration or impact applied to the main watch body and causing the light emitting elements to emit light.

BRIEF DESCRIPTION OF THE DRAWINGS

The invention will be further illustrated with the help of the following figures.

DESCRIPTION OF THE REFERENCE NUMERALS

1-Main watch body; 3-Face;

8-Operation button (push button);

9-Operation button (pull button);

12, 13, 14-Light emitting element (light emitting diode);

17-Sensor and 18-Stabilizer (operation memory function) element;

20, 21, 22- Electro-luminescence element;

10- Light-emitting element.

DETAILED DESCRIPTION OF THE INVENTION

The present invention relates to a wristwatch including a light emitting element. It is preferable that the main watch body is translucent. Furthermore, the plurality of light emitting elements may be formed to have the shape of rings of different diameters and concentrically arranged on the surface of a light-transmissive face.

Figure 1:
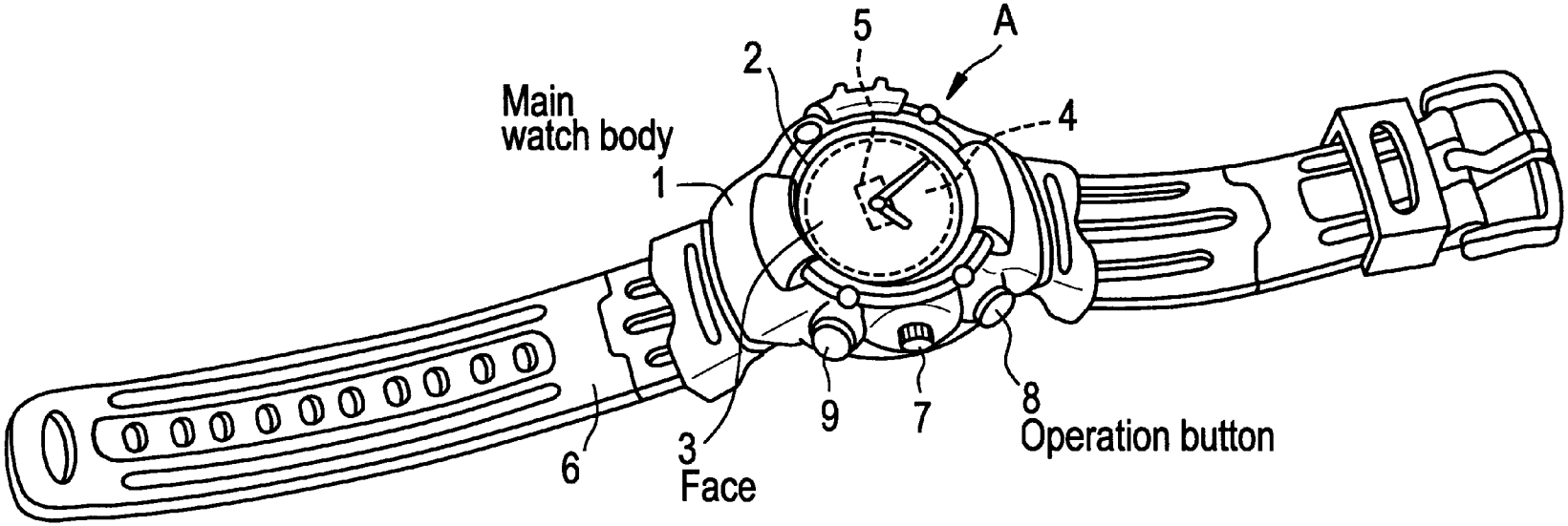
FIG. 1 shows a perspective view of a wristwatch according to the present invention.

FIG. 1 shows a wristwatch according to the present invention. The wristwatch A is a quartz watch. A main watch body 1 is formed of a translucent synthetic resin such as polyethylene. A glass plate 2 is fit in a top surface of the main watch body 1. Below a face 3, a printed circuit board 4 and a known watch driving mechanism 5 are arranged. The wristwatch A is formed to be attachable to the arm by a belt 6. On one side surface of the main watch body 1, two operation buttons 8 and 9 are provided while interposing a stem 7 for time adjustment. One of the operation buttons 8 is formed of a push button, which is operable by pushing, and the other operation button 9 is formed of a pull button, which is operable by pulling.

Figure 2:
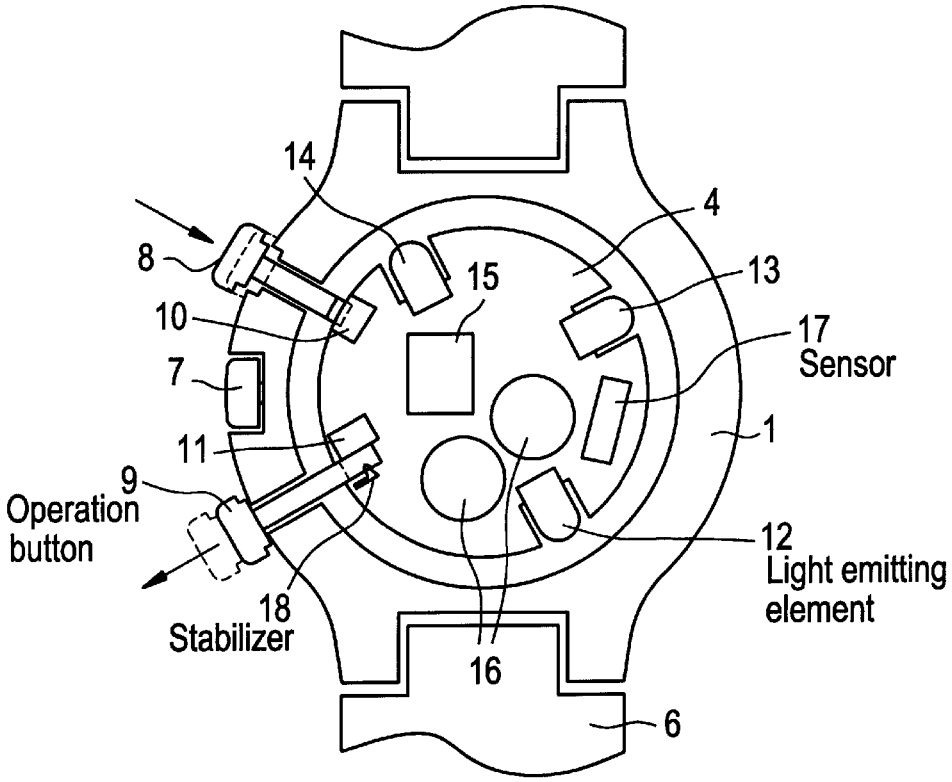
FIG. 2 shows an illustrative view of an inner structure of the wristwatch.
Figure 3:
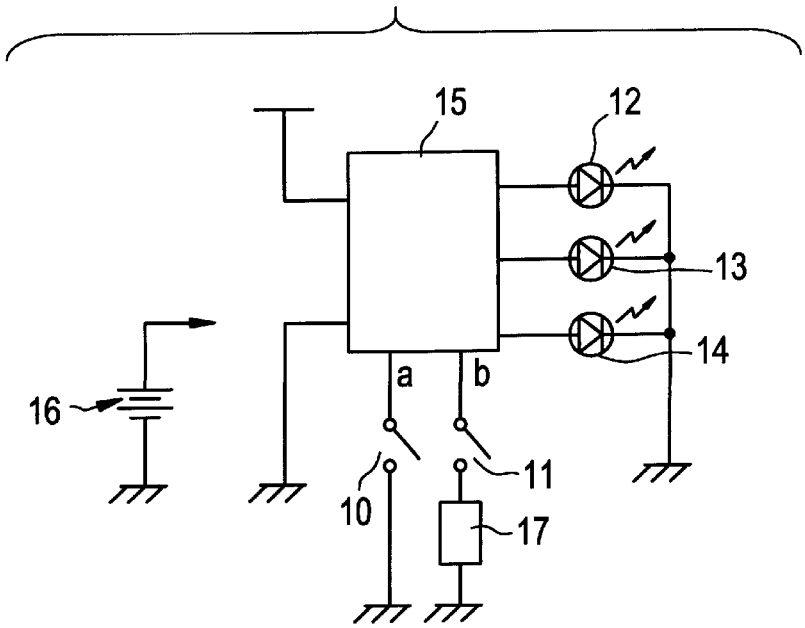
FIG. 3 is a block diagram illustrating one structure of the wristwatch.

As shown in FIG. 2, the printed circuit board 4 has a first start switch 10, a second start switch 11, light emitting diodes 12, 13 and 14 as light emitting elements, a control circuit 15 for controlling the three light emitting diodes 12, 13 and 14 to flash sequentially for a prescribed time period, and a button cell 16 as a power source. The push button 8 is provided on the side surface of the main watch body 1 with a head portion thereof projecting so that it can be pushed and is constantly loaded by a spring so that the head portion projects outward. When the push button 8 is structured to cause a tip thereof to project into the main watch body 1 when being pushed against the spring, thereby turning on the first start switch 10 and inputting an ON signal "a" from the first start switch 10 to the control circuit 15 (see FIG. 3).

The pull button 9 is provided on the side surface of the main watch body 1 so that it can be pulled. The pull button 9 is structured to project by a prescribed distance when a head portion thereof is pulled outward and to remain in the operation state by a stabilizer 18. When the head portion of the pull button 9 is pulled, the pull button 9 is pulled out by a prescribed length and a tip thereof turns on the second start switch 11. A vibration sensor 17, for sensing vibrations and impacts, is connected in series to the second start switch 11. Thus, only when the second start switch 11 is on, the vibrations and impacts are detected and a detection signal "b" is input to the control circuit 15.

The control circuit includes a timer circuit, a driving circuit for controlling flashing of the light emitting diodes, and the like. When an ON signal "a" or a detection signal "b" is input, the light emitting diodes 12, 13 and 14 are sequentially caused to flash. When the timer circuit determines that a prescribed time period has passed, the flashing of the light emitting diodes 12, 13 and 14 is stopped. According to the wristwatch having the above described structure, when the push button 8 is pushed, the first start switch 10 starts. The ON signal "a" from the first start switch 10 is input to the control circuit 15. The control circuit 15 controls the light emitting diodes 12, 13 and 14, using the ON signal "a" as a trigger, to flash sequentially as shown in FIG. 4, so that the light appears to be moving around in the watch.

Figure 4A:
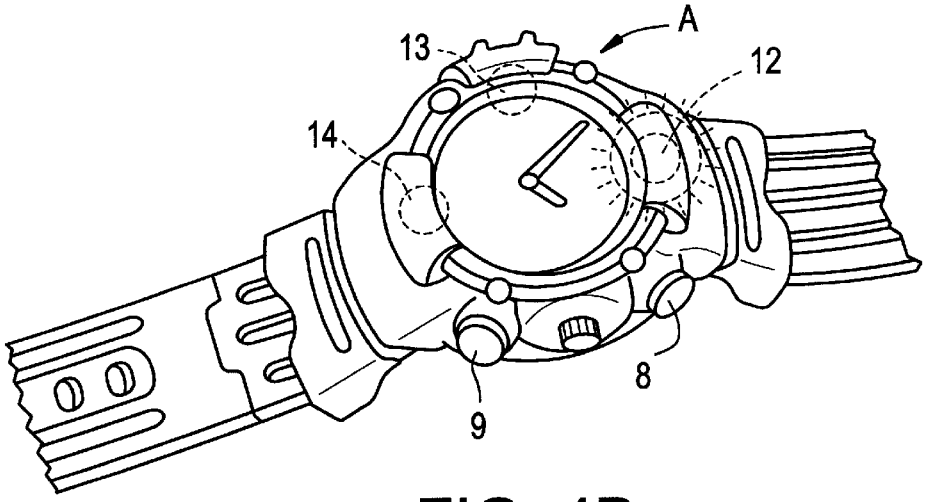
FIG. 4 (*a*), 4(*b*) and 4(*c*) are perspective views showing successive operational states of the wristwatch wherein the electro-luminescent elements are at points around the face of the watch.
Figure 4B:
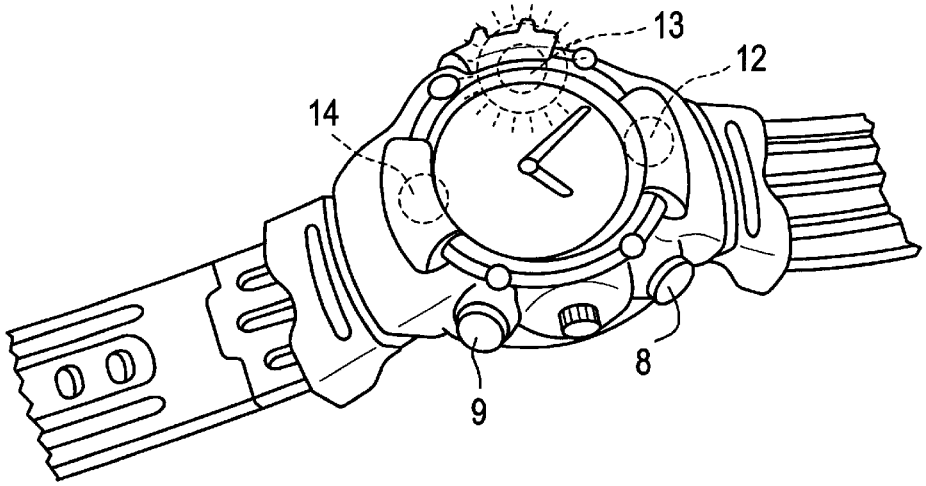
Figure 4C:
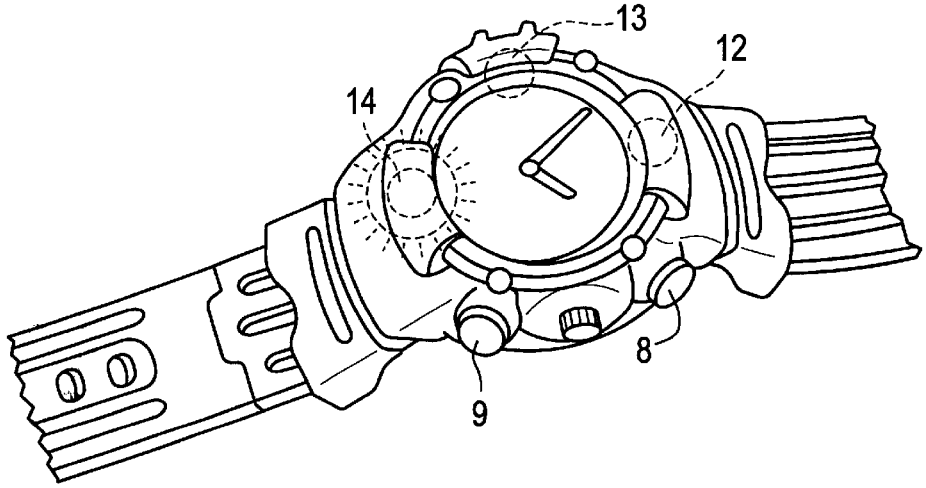

The states shown in FIGS. 4(*a*), 4(*b*) and 4(*c*) are repeated. When a prescribed time period passes, the control circuit 15 causes the light emitting diodes 12, 13 and 14 to stop emitting light and waits for the push button 8 to be pushed again. When the pull button 9 is pulled out, the second start switch 11 connected in series to the vibration sensor 17 is turned on. Accordingly, the vibration sensor 17 becomes enabled. Thus, when the vibration sensor 17 detects vibrations or impacts applied to the wristwatch A, the detection signal b is input to the control circuit 15.

When the detection signal "b" is input to the control circuit 15, the control circuit 15 controls the three light emitting diodes 12, 13 and 14, using the detection signal "b" as a trigger, to flash sequentially, so that the light appears to be moving around in the watch A. When a prescribed time period passes, the control circuit 15 causes the light emitting diodes 12, 13 and 14 to stop emitting light and waits for the vibration sensor 17 to detect vibrations or impacts again. While the pull button 9 is pulled out, the vibration sensor 17 is constantly in an enabled state and thus the light emitting diodes 12, 13 and 14 can be flashed by hand or body movement. Once the pull button 9 is pushed back, the second start switch 11 is turned off to open the circuit for the vibration sensor 17. Thus, the light emitting diodes 12, 13 and 14 cannot be flashed by hand or body movement.

The main watch body 1 is formed of a translucent resin. Accordingly, when the light emitting diodes 12, 13 and 14 flash, the emitted light is diffused in the resin. As a result, a large light spot appears to be moving inside the wristwatch. In this manner, even a small light spot can appear to be a large light spot. Thus, an amusing watch can be realized. The side surface of the main watch body may be covered with a cover member (not shown) formed of a translucent resin so that the light is diffused by the cover member.

Figure 5:
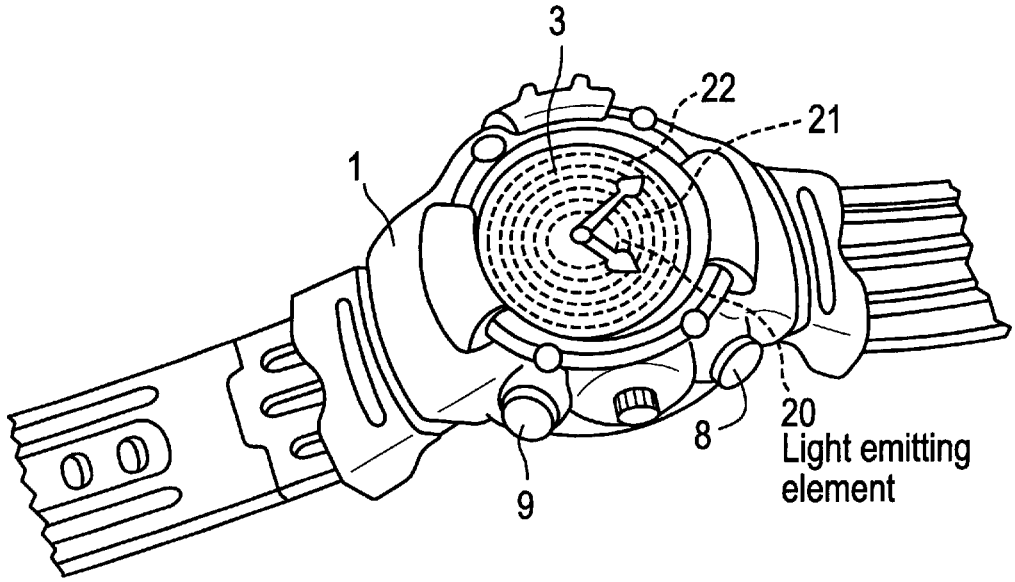
FIG. 5 shows a perspective view showing an example of the wristwatch wherein the electro-luminescent elements are in concentric circles.
Figure 6:
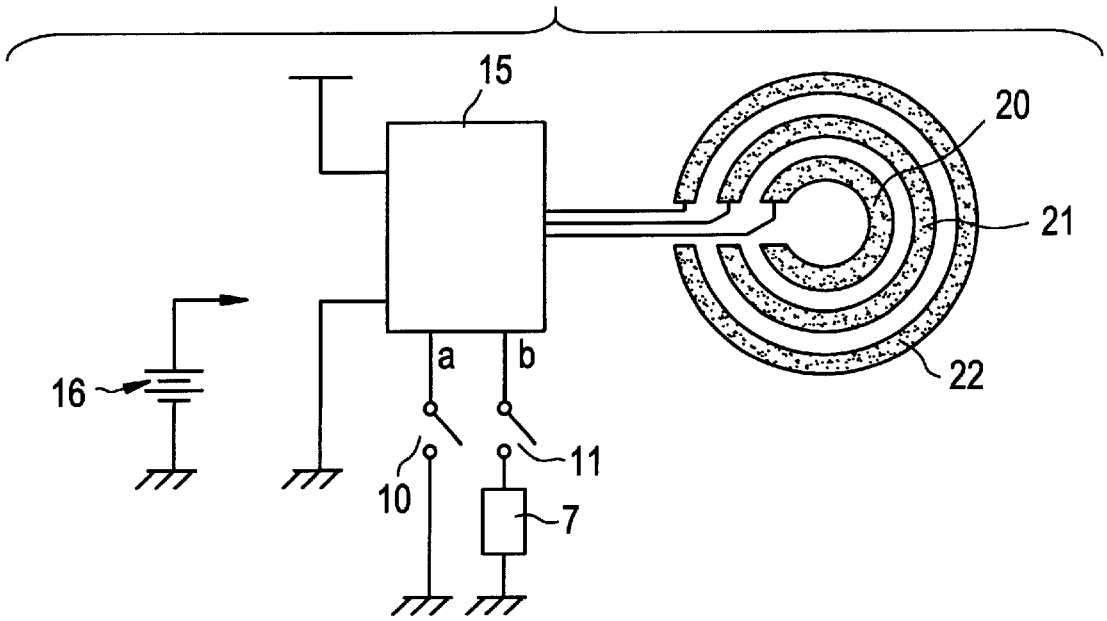
FIG. 6 shows a block diagram illustrating a structure of the wristwatch in an example wherein the electro-luminescent elements are in concentric circles.

Next, a wristwatch including electro-luminescence elements 20, 21 and 22 concentrically formed on a rear surface of a light-transmissive face as shown in FIG. 5 will be described. The electro-luminescence elements 20, 21 and 22 are controlled by the control circuit 15 to flash sequentially from an outer one to an inner one or from an inner one to an outer one. When the push button 8 is pushed, the first start switch 10 is turned on. When the pull button 9 is pulled, the vibration sensor 17 for detecting vibrations and impacts applied to the wristwatch becomes enabled. The ON signal a from the first start switch 10 and the detection signal "b" from the vibration sensor 17 obtained when the second start switch 11 is on, are input to the control circuit 15.

According to the wristwatch having the above described structure, when the push button 8 is pushed, the first start switch 10 is turned on. The ON signal "a" from the first start switch 10 is input to the control circuit 15. The control circuit 15 controls the three electro luminescence elements 20, 21 and 22, using the ON signal "a" as a trigger, to illuminate the face 3 from below and also to flash, so that rings of light appear to be expanding or contracting. When a prescribed time period passes, the control circuit 15 causes the electro luminescence elements 20, 21 and 22 to stop emitting light and waits for the push button 8 to be pushed again.

Figure 7A:
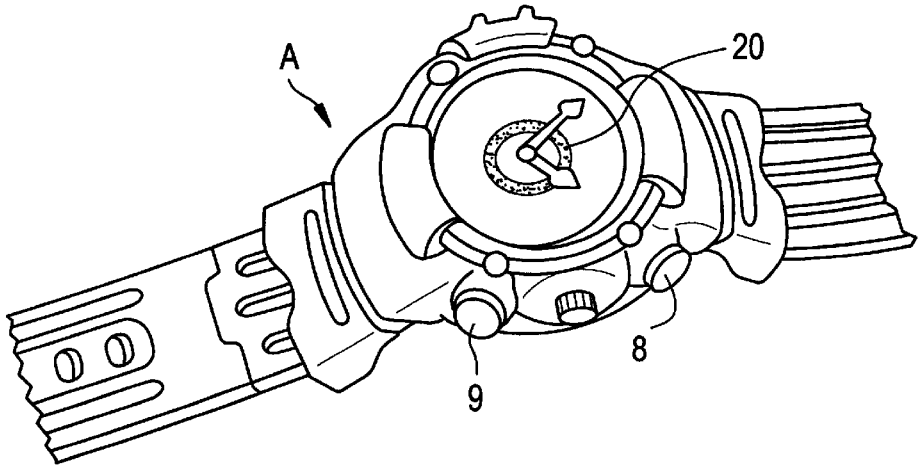
FIGS. 7(*a*), 7(*b*) and 7(*c*) are perspective views showing successive operational states of the wristwatch in an example wherein the electro luminescent elements are in concentric circles.
Figure 7B:
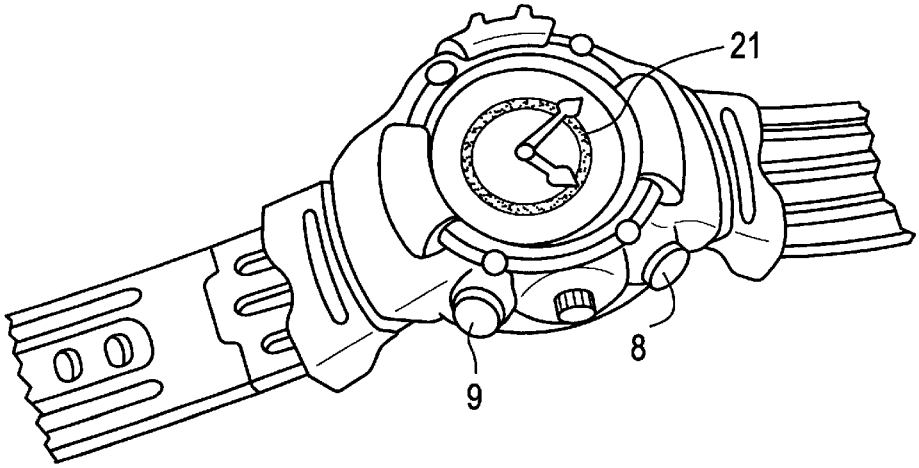
Figure 7C:
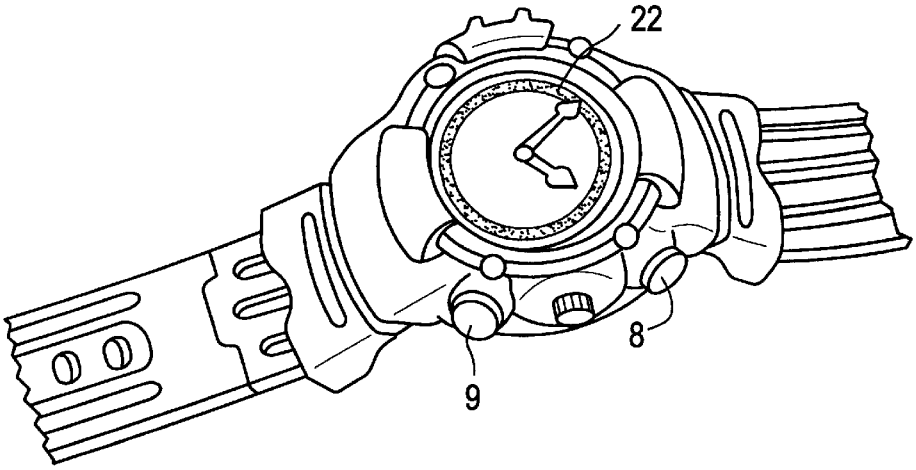

When the pull button 9 is pulled out, the second start switch 11 connected in series to the vibration sensor 17 is turned on. Accordingly, the vibration sensor 17 becomes enabled. Thus, when the vibration sensor 17 detects vibrations or impacts applied to the wristwatch, the detection signal "b" is input to the control circuit 15. When the detection signal "b" is input to the control circuit 15, the control circuit 15 causes the three electro luminescence elements 20, 21 and 22 to flash sequentially so that rings of light appear to be expanding or contracting. The states in FIGS. 7(*a*), 7(*b*) and 7(*c*) are repeated in this order. When a prescribed time period passes, the control circuit 15 causes the electro luminescence elements 20, 21 and 22 to stop emitting light and waits for the vibration sensor 17 to detect vibrations or impacts again. While the pull button 9 is pulled out, the vibration sensor 17 is constantly in an enabled state and thus the electroluminescence elements 20, 21 and 22 can be caused to flash by hand or body movement. Once the pull button 9 is pushed back, the second start switch 11 is turned off to open the circuit for the vibration sensor 17. Thus, the electro luminescence elements 20, 21 and 22 cannot be caused to flash by hand or body movement.

According to the invention, a plurality of light emitting elements provided inside the main watch body are caused to flash by pushing an operation button, thereby illuminating the face. The light emitting elements sequentially flash. Accordingly, the wristwatch is both practical as well as entertaining. According to another embodiment of the invention, the operation of a built-in sensor for detecting vibrations or impacts can be controlled by an operation button. Accordingly, the light emitting elements are not always caused to flash by vibrations or impacts. The time and place for the light emitting elements to flash can be arbitrarily selected. The wristwatch can also be enjoyed as a glowing object such as a pen light which can be caused to flash in accordance with the movement of the body. According to another embodiment of the invention, the main watch body diffuses the light from the light emitting elements, and thus the entire main watch body appears to emit light. Thus, a wristwatch with further amusing features can be realized.

According to another embodiment of the invention, the rings of light appear to be expanding or contracting below the face although the face is usually an ordinary face. Accordingly, a wristwatch having a practical function of illuminating the face as well as unexpected and enjoyable features can be provided.

What is claimed is:

1. A wristwatch, comprising a plurality of light emitting elements provided for emitting light by applying electric energy to a main watch body, wherein the light emitting elements are caused to flash sequentially for a prescribed time period by operating an operation button provided so as to be operable from outside the main watch body, wherein the operation button has an operation memory function and, when operated, makes a sensor operable for sensing a vibration or impact applied to the main watch body and causing the light emitting elements to emit light.

2. The wristwatch according to claim 1, wherein the main watch body is translucent.

3. The wristwatch according to claim 1, wherein the face of the watch, having a front surface facing outward from the watch and a rear surface facing inward toward the watch, is light-transmissive, and wherein the plurality of light emitting elements are formed to have the shape of rings of different diameters and are concentrically arranged on the rear surface of the light-transmissive face.

4. The wristwatch according to claim 1, wherein the main watch body is translucent.

5. The wristwatch according to claim 1, wherein the face of the watch, having a front surface facing outward from the watch and a rear surface facing inward toward the watch, is light-transmissive, and wherein the plurality of light emitting elements are formed to have the shape of rings of different diameters and are concentrically arranged on the rear surface of the light transmissive face.

6. The wristwatch according to claim 2, wherein the plurality of light emitting elements are formed to have the shape of rings of different diameters and are concentrically arranged on the rear surface of the light transmissive face.

7. A wristwatch comprising a plurality of light emitting elements provided for emitting light by applying electric energy to a main watch body, wherein the light emitting elements are caused to flash sequentially for a prescribed time period by operating an operation button provided so as to be operable from outside the main watch body, wherein the plurality of light emitting elements are formed to have the shape of rings of different diameters and are concentrically arranged on the rear surface of the light transmissive face.

* * * * *